US010650792B2

(12) United States Patent
Israel

(10) Patent No.: US 10,650,792 B2
(45) Date of Patent: May 12, 2020

(54) PERCUSSION DEVICE AND SYSTEM FOR STRINGED INSTRUMENT

(71) Applicant: KAIDEN INSTRUMENTS LTD, Herzliya (IL)

(72) Inventor: Yaron Israel, Herzliya (IL)

(73) Assignee: KAIDEN INSTRUMENTS LTD., Herzliya (IL)

( * ) Notice: Subject to any disclaimer, the term of this patent is extended or adjusted under 35 U.S.C. 154(b) by 0 days.

(21) Appl. No.: 15/753,435

(22) PCT Filed: Aug. 16, 2016

(86) PCT No.: PCT/IL2016/050892

§ 371 (c)(1),
(2) Date: Feb. 19, 2018

(87) PCT Pub. No.: WO2017/029663

PCT Pub. Date: Feb. 23, 2017

(65) Prior Publication Data

US 2018/0240444 A1 Aug. 23, 2018

Related U.S. Application Data

(60) Provisional application No. 62/206,890, filed on Aug. 19, 2015.

(51) Int. Cl.
*G10D 13/02* (2006.01)
*G10D 1/08* (2006.01)
(Continued)

(52) U.S. Cl.
CPC ..... *G10D 13/02* (2013.01); *G10D 1/08* (2013.01); *G10D 15/00* (2013.01); *G10G 5/005* (2013.01);
(Continued)

(58) Field of Classification Search
CPC ..... G10D 13/02; G10D 1/08; G10D 15/00; G10G 5/005; G10H 1/0008; G10H 1/32; G10H 3/143; G10H 3/146
(Continued)

(56) References Cited

U.S. PATENT DOCUMENTS 398,176 A * 2/1889 Oerlein ..... G10D 3/02 84/290
2,033,826 A * 3/1936 Haium ..... G10D 15/00 84/173
(Continued)

FOREIGN PATENT DOCUMENTS

FR 2941810 A1 * 8/2010 ..... G10D 3/00
GB 2348735 A 10/2000
JP S52116229 A 9/1977

OTHER PUBLICATIONS

International Search Report of Application No. PCT/IL2016/050892 dated Dec. 5, 2016.
(Continued)

*Primary Examiner* — David S Warren
*Assistant Examiner* — Christina M Schreiber
(74) *Attorney, Agent, or Firm* — Pearl Cohen Zedek Latzer Baratz LLP

(57) ABSTRACT

The invention is directed to a percussion system to be attached to a stringed instrument in a way that allows a player to drum the percussion system while plucking the strings of the stringed instrument using a single hand. The percussion system includes a percussion device including: a body and at least one static percussion surface located over the body, the percussion surface having a batter side. The percussion system further includes a connecting element for connecting the percussion device to a stringed instrument such that when the percussion system is connected to the stringed instrument the percussion surface is substantially
(Continued)

perpendicular to the stringed instrument's front side and is directed towards strings of the stringed instrument.

20 Claims, 13 Drawing Sheets

(51) Int. Cl.
*G10D 15/00* (2006.01)
*G10G 5/00* (2006.01)
*G10H 1/00* (2006.01)
*G10H 1/32* (2006.01)
*G10H 3/14* (2006.01)

(52) U.S. Cl.
CPC ..... *G10H 1/0008* (2013.01); *G10H 1/32* (2013.01); *G10H 3/143* (2013.01); *G10H 3/146* (2013.01); *G10H 2220/525* (2013.01); *G10H 2230/141* (2013.01); *G10H 2230/275* (2013.01); *G10H 2230/365* (2013.01)

(58) Field of Classification Search
USPC ..... 84/170
See application file for complete search history.

(56) References Cited

U.S. PATENT DOCUMENTS 3,375,747 A * 4/1968 Posey ..... G10D 3/00 84/453
3,680,423 A * 8/1972 Lander ..... G10D 15/00 84/170
3,743,751 A * 7/1973 Ibanez ..... G10H 1/40 84/741
5,105,711 A 4/1992 Barnard
5,900,573 A * 5/1999 Barnes ..... G10D 15/00 84/171
6,369,304 B1 * 4/2002 Tucker ..... G10D 3/00 84/267
6,441,293 B1 * 8/2002 LaBarbera ..... G10H 3/146 84/290
6,696,632 B2 * 2/2004 Minakuchi ..... G10H 1/32 84/290
7,339,107 B2 * 3/2008 Remignanti ..... G10H 1/0091 84/723
7,982,124 B1 * 7/2011 Landis ..... G10H 3/18 84/727
8,853,511 B2 * 10/2014 DePue, Jr. ..... G10D 3/00 84/274
8,907,201 B2 * 12/2014 Jensen ..... G10D 15/00 84/743
9,691,363 B2 * 6/2017 McHugh ..... G10D 3/00
10,096,309 B2 * 10/2018 Suitor ..... G10H 3/188
2003/0131721 A1 * 7/2003 Minakuchi ..... G10H 1/32 84/726
2014/0102279 A1 4/2014 Jensen
2017/0032775 A1 * 2/2017 Schlessinger ..... G10H 3/146
2018/0240444 A1 * 8/2018 Israel ..... G10H 3/143

OTHER PUBLICATIONS

European Search Report for EP application No. EP16836748.0, dated Apr. 3, 2019.

* cited by examiner

PERCUSSION DEVICE AND SYSTEM FOR STRINGED INSTRUMENT

CROSS-REFERENCE TO RELATED APPLICATIONS

This application is a U.S. National Phase Application of PCT International Application No. PCT/IL2016/050892, International Filing Date Aug. 16, 2016, claiming priority of U.S. Provisional Patent Application No. 62/206,890, filed Aug. 19, 2015, which are hereby incorporated by reference.

BACKGROUND OF THE INVENTION

A "one man band" usually refers to a single player playing simultaneously on various instruments, for example, a guitar, a harmonica and a beat-drum operated by the player's foot. The player, playing all the various instruments, needs to concentrate and coordinate various body parts (e.g., hands playing the guitar, the mouth and breath playing the harmonica and the foot). Several attempts have been made to combine two or more instruments together, for example, adding an electronic drum trigger(s) to a side panel of a guitar for producing sounds while or in addition to plucking the strings.

Most of the percussion devices attached to guitars or other stringed instruments are based on electronic devices such as electronic drums, piezoelectric devices, touch screens or the like. The sound produces by such a device was prerecorded electronically and then played upon activation (triggering) of the device rather than being formed acoustically by hitting an acoustic drum in real time. Most elements (for example, piezoelectric devices) are attached to the stringed instrument soundbox such that the player can hit the device using a single hand before or after (but not while) plucking the strings.

SUMMARY OF THE INVENTION

Embodiments of the invention may be directed to a percussion system to be attached to a stringed instrument in a way that allows a player to drum the percussion system while plucking the strings of the stringed instrument using a single hand. The percussion system may include a percussion device including: a body and at least one static percussion surface located over the body, the percussion surface having a batter side. The percussion system may further include a connecting element for connecting the percussion device to a stringed instrument such that when the percussion system is connected to the stringed instrument the percussion surface is substantially perpendicular to the stringed instrument's front side and is directed towards strings of the stringed instrument.

Some other embodiments may be directed to a percussion system that includes: a percussion surface having a batter side, an actuator, a tapping element, a transmission unit and a first connecting element. In some embodiments, the actuator may be configured to move along a first axis when the batter side of the percussion surface is hit. In some embodiments, the transmission unit is configured to transfer the actuator's movement along the first axis to a tapping element's movement along a second axis. In some embodiments, the first axis and the second axis are substantially perpendicular to each other. In some embodiments, the first connecting element is configured to connect the percussion system to a stringed instrument such that when the percussion system is connected to the stringed instrument the batter side of the percussion surface is substantially perpendicular to the stringed instrument's front panel and is directed towards strings of the stringed instrument.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
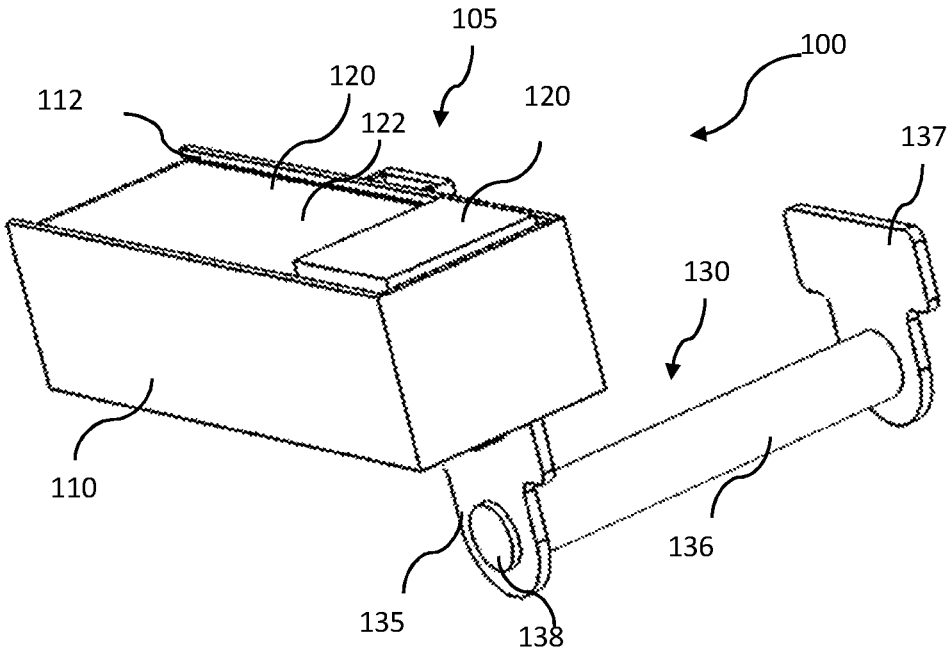
FIGS. 1A and 1B are illustrations of an exemplary percussion system according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Embodiments of the invention may be directed to a percussion system to be attached to a stringed instrument in a way that allows a player to drum the percussion system while plucking the strings of the stringed instrument using a single hand. The stringed instrument may be guitar, sitar, electric guitar, electric bass, double bass, rebab, banjo, mandolin, ukulele, bouzouki or the like. The percussion system may include a percussion device and a connecting element. The percussion device may include a static percussion surface to be drummed by the player. The static percussion surface may be statically connected to a body of the percussion device without the ability to move with respect to the body. Upon hitting the static percussion surface the percussion device may form a sound. The sound may be a drumming sound, a bass sound, a kicking sound or any other sound that may be produced by the percussion device. In some embodiments, a percussion device may include a dynamic percussion surface that is configured to move when the player hits the percussion surface.

A percussion system according to embodiments of the invention may allow a player to use the same hand movement for hitting the percussion surface and plucking the strings of the stringed instrument. The percussion surface may be located below or above the strings allowing the swinging hand plucking the strings to hit the percussion surface at the same swing (either during down-stroke or up-stroke) in less than a predetermined period of time, for example, less than 0.01 second. The rhythm of the produced sounds (e.g., the pace of hitting the percussion surface) may be similar to the hand swinging frequency. In order to do so, the percussion system according to embodiments of the invention may include a connecting element for connecting the percussion device to the stringed instrument such that when the percussion device is connected to the stringed instrument the batter side (e.g., exposed side, outer side, the batter head, etc.) of the percussion surface is substantially perpendicular to the stringed instrument's front side and is directed towards the strings of the stringed instrument. A percussion device according to some embodiments of the invention may be configured to produce an acoustic sound and/or an electronic sound.

Figure 1B:
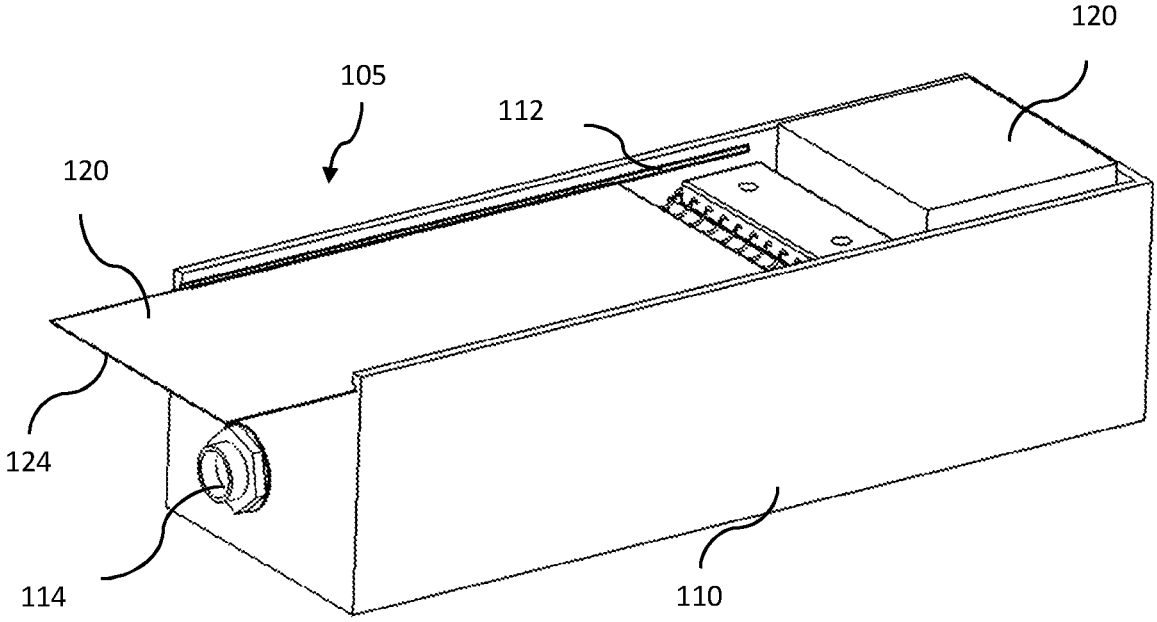

Reference is now made to FIGS. 1A and 1B which are illustrations of an exemplary percussion system according to some embodiments of the invention. An embodiment of percussion system 100 may include a percussion device 105 (illustrated in FIG. 1B) and a connecting element 130 for connecting percussion device 105 to a stringed instrument. Percussion device 105 may include a body 110 and at least one static percussion surface 120 located over body 110.

Body 110 may have any shape that can support percussion surface 120. Body 110 may be hollow or may be full. According to some embodiments body 110 may have a form of a box or a frame. Body 110 may comprise a soundbox (also known in the art as sounding board, sounding box or sound board). Body 110 may include one or more connectors 114. According to some embodiments, connector 114 may connect device 105 of system 100 to an amplifier, a sound module, a processor, a piezoelectric device, or the like. Connector 114 may include any device that may allow connecting electronic components included in percussion system 100 to external system(s) via wired or wireless communication devices. Connector 114 may include connectors for connecting wires for conducting wired communication and/or antennas or transceivers for conducting wireless communication. The wireless communication may include: Wi-Fi communication, Bluetooth communication, or the like.

In some embodiments, body 110 may include mounting elements 112 for mounting static percussion surface 120. Mounting elements 112 may include any devices, means, bodies or the like for mounting a surface to a body. For example, mounting elements 112 illustrated in FIG. 1B may include rails. In yet another example, mounting elements 112 may include: clamps, screws, stickers, adhesives or the like. Mounting element 112 may allow replacing one type of percussion surface 120 with another type of percussion surface, for example, replacing a percussion surface comprising snare wires (illustrated and discussed with respect to FIGS. 4A and 4B) with a percussion surface comprising an electronic drum trigger (illustrated and discussed with respect to FIGS. 5A and 5B).

At least one static percussion surface 120 may be mounted by mounting elements 112 to body 110. Percussion surface 120 may have a batter side 122 and an internal side 124 (illustrated in FIG. 3B). Percussion surface 120 may be statically connected by mounting elements 112 to body 110 in a way that does not allow percussion surface 120 to move substantially with respect to body 110, for example, the maximal movement of surface 120 may be a slight movement (such as a movement of a few millimeters (mm)) when hitting surface 120. The movement may be due to the elasticity of the material included in surface 120.

In some embodiments, percussion system 100 may include two or more percussion surfaces. In such case at least one of the percussion surfaces may be static percussion surface 120 and another percussion surface(s) may also be static (e.g., surface 120) or dynamic percussion surface. A dynamic percussion surface according to some embodiments of the invention may be defined as a percussion surface that is allowed to move with respect to body 110 and/or connecting element 130 when hit by a player. Exemplary dynamic percussion surfaces are disclosed below with respects to the embodiments of FIGS. 6A-6C and 7A-7C.

Percussion surface 120 may include or may be included in any element or device that produces sound when hit. For example, when body 110 includes a soundbox, percussion surface 120 may include a drum skin placed over an opening in the soundbox, as illustrated in FIGS. 1A and 1B. In some embodiments, the drum skin may be located at two opposite surfaces of body 110, percussion surface 120 and the opposite surface from the other side of the soundbox.

In some embodiments, percussion surface 120 may include an elastic material starched over body 110, such elastic material may include leather or plastic or the like. In such cases body 110 may include stretching elements (not illustrated) for stretching an elastic percussion surface 120 over body 110. The stretching may allow changing the pitch, thus tuning elastic percussion surface 120. For example, according to one embodiment, stretching surface 120 may result in a higher sound produced by surface 120 when hit.

In some embodiments, static percussion surface 120 may include a rigid material plate placed over body 110 and connected to body 110 at least from one side of the plate. Such a rigid plate may have some elasticity and may include for example, a thin metal (e.g., aluminum alloy, copper alloy steel or the like) plate. Rigid percussion surface 120 may be connected to body 110 in one, two or more sides, using for example, screws, bolts, adhesives, rails or the like. The connection to body 110 may allow slight movement of surface 120 due to the elasticity of the material and/or the elasticity of mounting elements 112 connecting surface 120 to body 110.

In some embodiments, percussion system 100 may further include a connecting element 130 for connecting percussion device 105 of system 100 to a stringed instrument. Connecting element 130 may include any element, device, system or the like that allows simple attachment and detachment of percussion device 105 to a string instrument (e.g., instrument 200 illustrated in FIGS. 2A-2C). Connecting element 130 may further connect percussion device 105 to the stringed instruments such that percussion surface 120 is perpendicular to the front panel of the stringed instrument and the exposed face or batter head (e.g., batter side 122) of percussion surface 120 may be directed towards the strings of the stringed instrument.

Figure 2A:
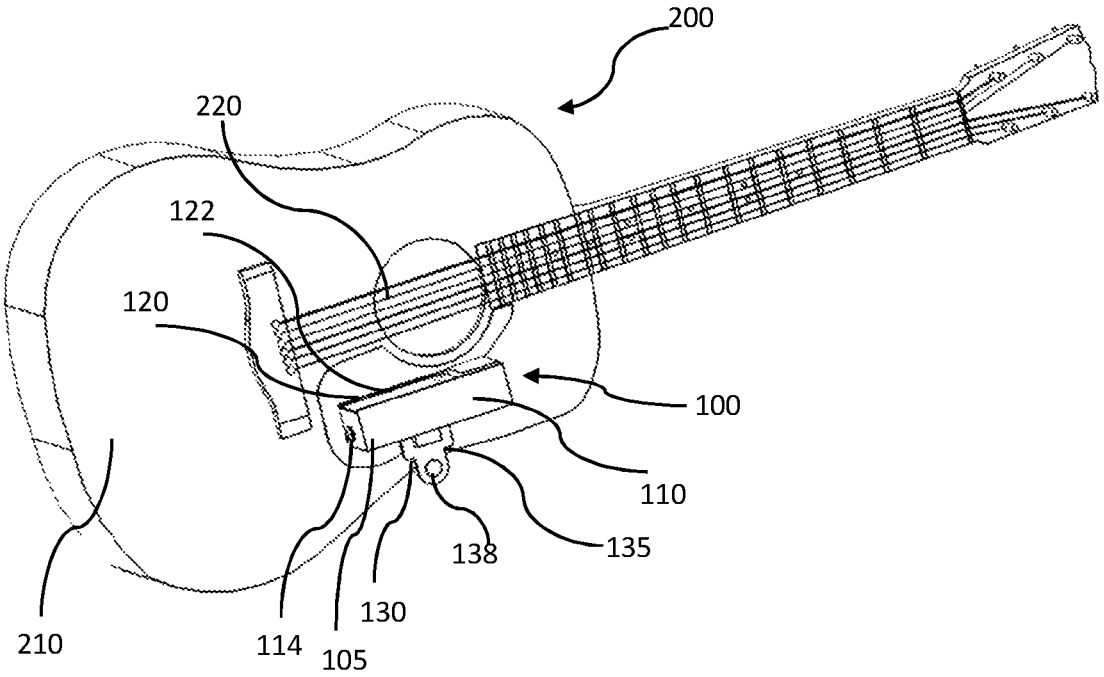
FIGS. 2A and 2B are two views of an illustration of the exemplary percussion system connected to a stringed instrument according to some embodiments of the invention.
Figure 2B:
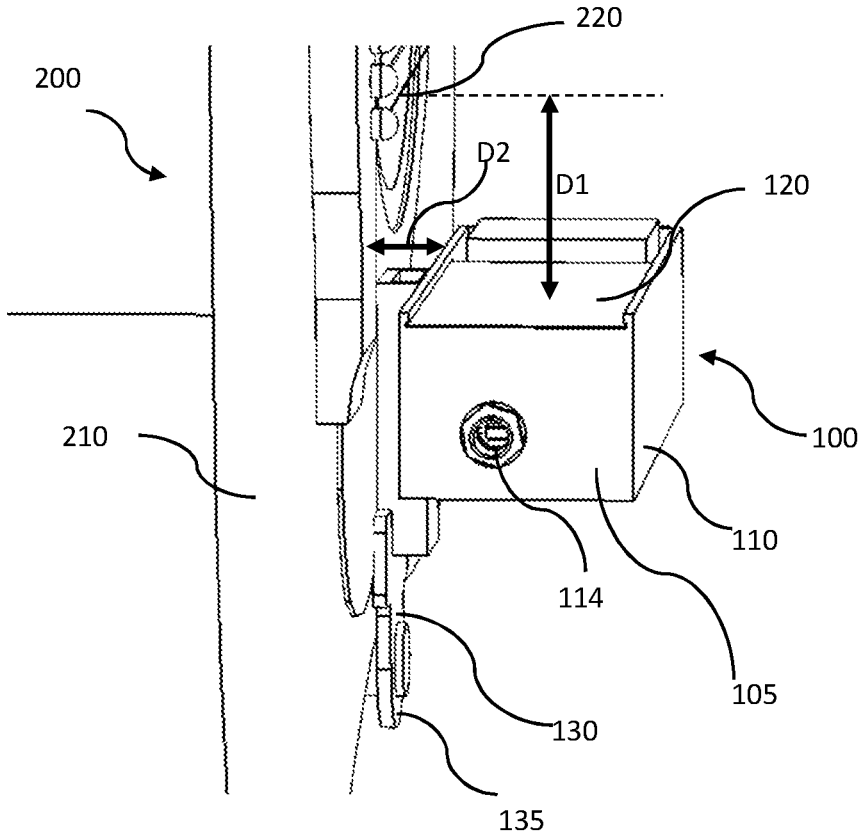

Reference is made to FIGS. 2A and 2B which are illustrations of a front and side views of a percussion system connected to a stringed instrument according to some embodiments of the invention. Percussion system 100 may be connected to a stringed instrument 200 such that batter side 122 of percussion surface 120 may be substantially perpendicular to the stringed instrument's front panel 210 and may further be directed towards strings 220 of stringed instrument 200. Stringed instrument 200 may be, for example, a guitar (illustrated), a sitar, an electric guitar, an electric bass, a double bass, a rebab, a banjo, a mandolin, a ukulele, a bouzouki or the like. In some embodiments, connecting element 130 may connect percussion device 105 to the stringed instrument such that a player can hit batter side 122 of percussion surface 120 while plucking strings 220 of stringed instrument 200 using the plucking hand.

In some embodiments, stringed instrument 200 may not necessarily include a panel such as front panel 210. Stringed instrument 200 may be an electric stringed instrument having a little or no body, such as for example, an electric cello. In such case batter side 122 of percussion surface 120 may be substantially perpendicular to the stringed instrument's front side. The front side of stringed instrument 200 may be defined as the side of the strings.

An exemplary percussion system may include a clamp 135 (illustrated in FIGS. 1A and 2A-2C) configured to removably connect percussion system 100 to the stringed instrument such that percussion surface 120 is substantially perpendicular to stringed instrument's front side 210 and is directed towards strings 220 of stringed instrument 200.

The exemplary clamp 135, illustrated in FIGS. 1A and 2A-2C, includes and adjustable arm 136, a fastener 137 and adjustment screw 138. Exemplary clamp 135 may be adjusted by tightening or loosing adjustment screw 138. It should be understood by one skilled in the art that clamp 135 illustrated in FIGS. 1-2 is given as an example only and the invention as a whole is not limited to that particular clamp, thus connecting element 130 may include any clamp or clamping mechanism that may allow connecting percussion device 105 of system 100 to the stringed instrument such that percussion surface 120 is substantially perpendicular to stringed instrument's front side 210 and is directed towards strings 220 of stringed instrument 200, as illustrated and discussed with respects to FIGS. 8A-8C. In some embodiments, connecting element 130 may be located on a side of body 110 perpendicular to percussion surface 120, and may include at least one of: a removable sticker, a suction cup, hook and loop fastener, at least one screw or the like.

Figure 2C:
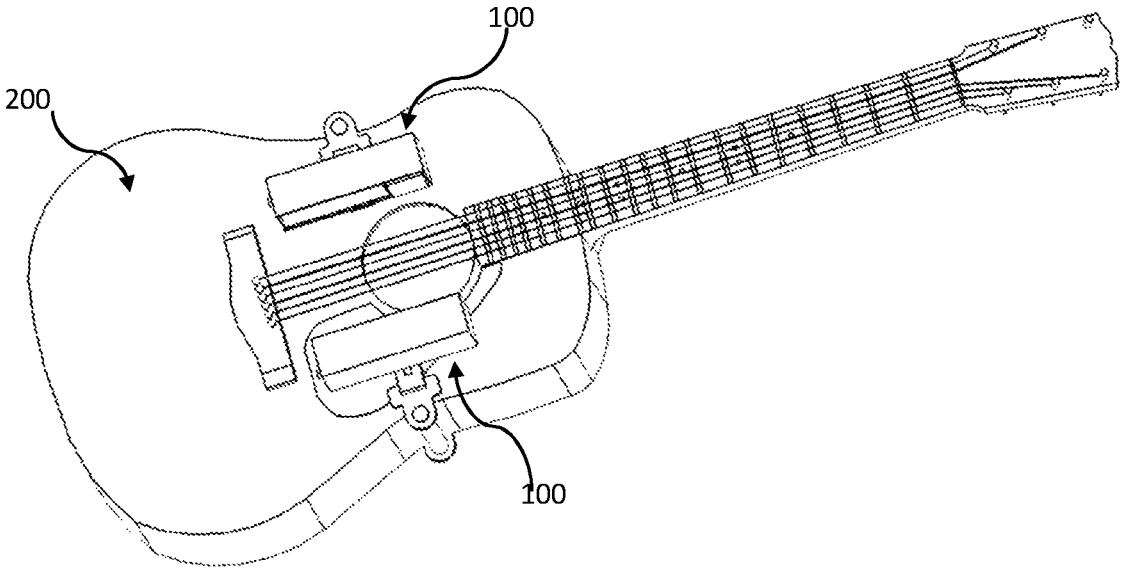
FIG. 2C is an illustration of an assembly of two percussion systems on a single stringed instrument according to some embodiments of the invention.

Connecting element 130 may be configured to allow adjusting a location of percussion device 105 of system 100, for example, to fit different players having different hand sizes. For example, percussion system 100 may be located above and/or below the strings such that batter side 122 is directed towards the strings, as illustrated in FIG. 2C. In the embodiment of FIG. 2C two percussion systems 100 are connected to the same stringed instrument 200 above and below the strings.

In some embodiments, connecting element 130 may further be configured to allow adjusting an orientation of percussion device 105 and of system 100, For example, slight adjusting of the angle (for example, up to 30°) of percussion device 105 and/or of system 100 and/or percussion surface 120, with respect to stings 220 may further be possible to allow comfortable operation of system 100 by the player. Connecting element 130 may be configured to adjust a distance D1 of percussion surface 120 from the lower string of strings 220 (or upper string when connected above the strings). Connecting element 130 may further be configured to adjust distance D2 of percussion surface 120 from front side (e.g., panel) 210 of stringed instruments 200, as illustrated in FIG. 2B.

Connecting element 130 may be located at any side of body 110, for example, the side opposite to surface 120, the side opposite to the stringed instrument's front side, etc. Percussion system 100 may include two separate devices, a percussion device 105 comprising body 110 and surface 120 and a separate connecting element 130 that may be mounted to the percussion system only when an attachment of the percussion device 105 to the stringed instrument is required. In some embodiments, a single connecting element 130 may be configured to connect several different percussion devices 105 each having a different body 110 and/or different surface 120. Such percussion devices 105 may be replaceable and the player may decide which percussion device 105 to connect using the same connecting element 130. For example, the player may replace a percussion device 105 comprising snare wires (illustrated in FIGS. 4A and 4B) with an electronic drum (illustrated in FIGS. 5A and 5B). The player may choose to leave connecting element 130 connected to the stringed instrument and may further connect the selected percussion device 105.

In some embodiments, all the elements of system 100 (e.g., body 110, surface 120 and connecting element 130) may be detachable and may be assembled together before playing the stringed instrument, using for example, mounting elements such as elements 112.

Figure 3A:
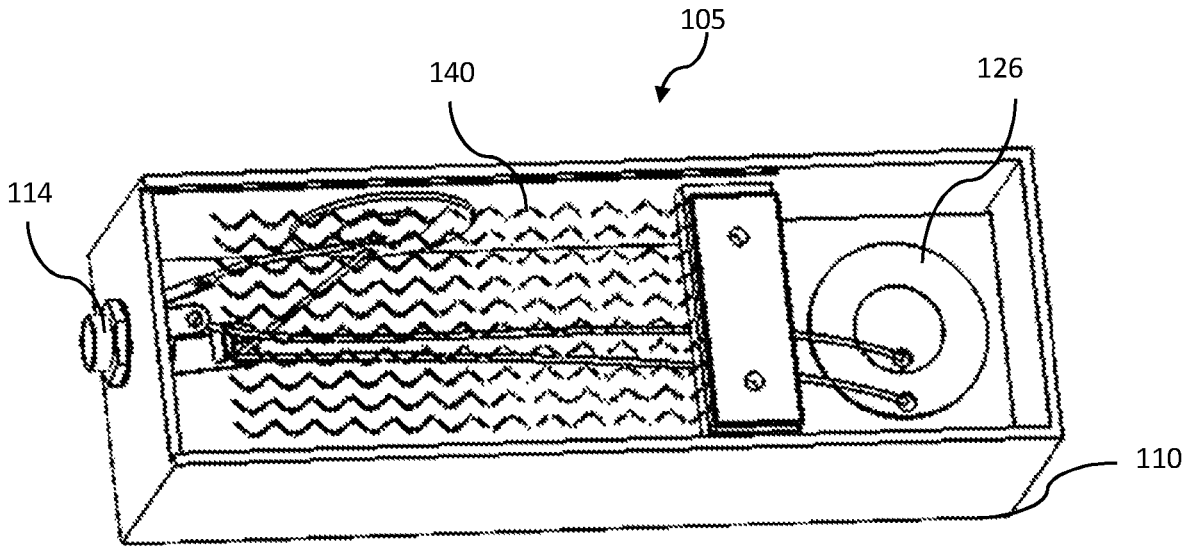
FIGS. 3A and 3B are illustrations of an exemplary percussion device according to some embodiments of the invention.
Figure 3B:
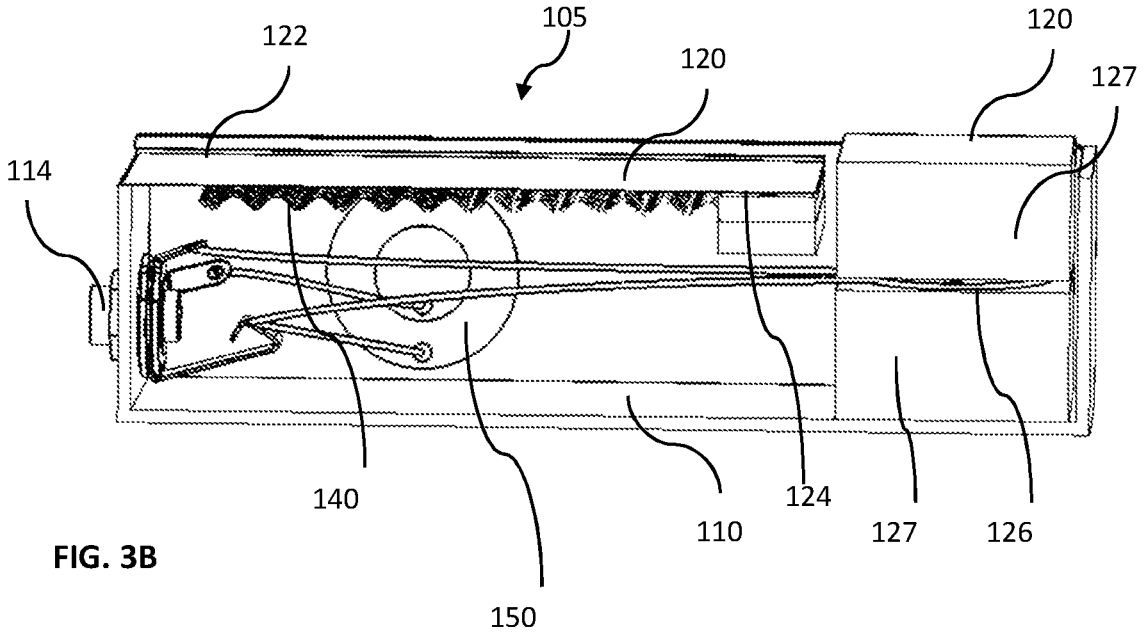

Reference is now made to FIGS. 3A and 3B which are illustrations of a percussion device according to some embodiments of the invention. FIG. 3A is an isometric top view of device 105 without percussion surface 120 and FIG. 3B is an isometric illustration of a side view of percussion device 105 after removing one side panel of body 110. Embodiments of percussion device 105 may include percussion surface 120 comprising at least one bass-sound forming element 126. The bass sound forming element may include one or more electrical, mechanical or electro-mechanical devices that produce bass sound upon percussion. An exemplary electrical bass sound forming element may include a piezoelectric device (illustrated in FIGS. 3A-3B), a microphone, a magnets wound with a coil (similarly to an electric guitar pickup) or the like. The bass sound forming element may be connected to an amplification system via a connector, for example, connector 114. One or more cables or antennas may connect element 126 to connector 114.

An electrical bass sound forming element such as piezoelectric device or a microphone may further require a damping element. In an exemplary embodiment, percussion device 105 may further include at least one damping element 127 (illustrated in FIG. 3B) for covering (e.g., protecting) at least one surface of the electric bass-sound forming element. In some embodiments, an additional dumping element 127 may cover the other side (internal side) of bass-sound forming element 126 for reducing undesired vibration. Such bass-sound forming element may produce a bass sound similar to a bass-sound produced by a large bass drum having relatively large acoustic body, for example, a large bass drum may have a diameter range from 16 to 28 inches (41 to 71 cm) and a depth range form 14 to 22 inches (36 to 56 cm).

Further in FIGS. 3A-3B embodiments of percussion device 105 may further include a rattler 140. Rattler 140 may include, for example, snare drum wires (as illustrated), dog tag chain, threaded beads or any other element that produces sound when vibrating against a surface. Rattler 140 may be connected to body 110 and/or surface 120 and may be rattled when surface 120 is hit, to produce, for example, a sound similar to the distinct sound of a snare drum. When hit, surface 120 may vibrate and transfer vibrations to rattler 140 and/or body 110. Additional exemplary rattlers may include beads threaded on a wire or a thread assembled in a groove (e.g., a reassess) in body 110. When hitting surface 120 the beads may produce sound.

System 100 may further include an additional piezoelectric device or a microphone 150 for capturing and amplifying the sound produced by rattler 140 and/or percussion surface 120. Device 150 may be connected to an amplifier and speakers (not illustrated) via connector 114.

Figure 4A:
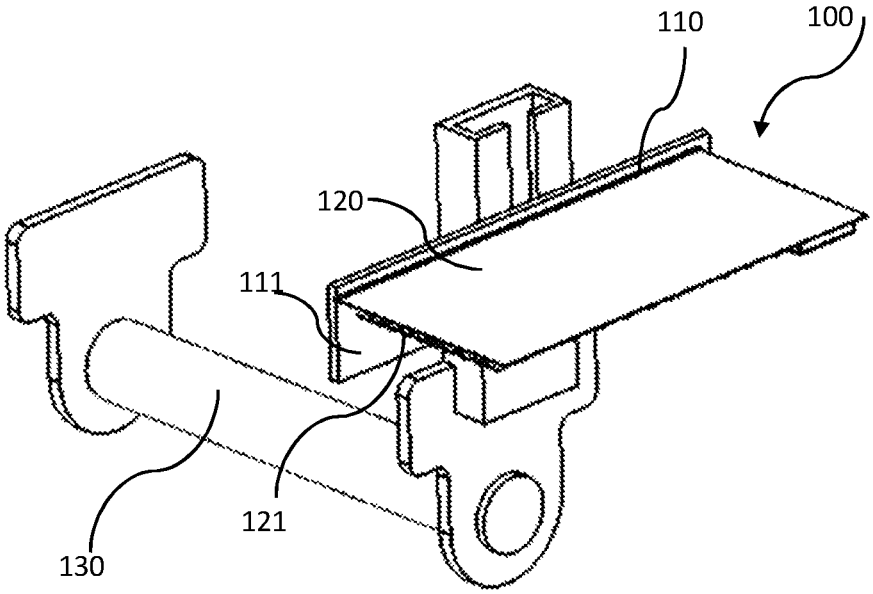
FIGS. 4A and 4B are illustrations of an exemplary percussion system according to some embodiments of the invention.
Figure 4B:
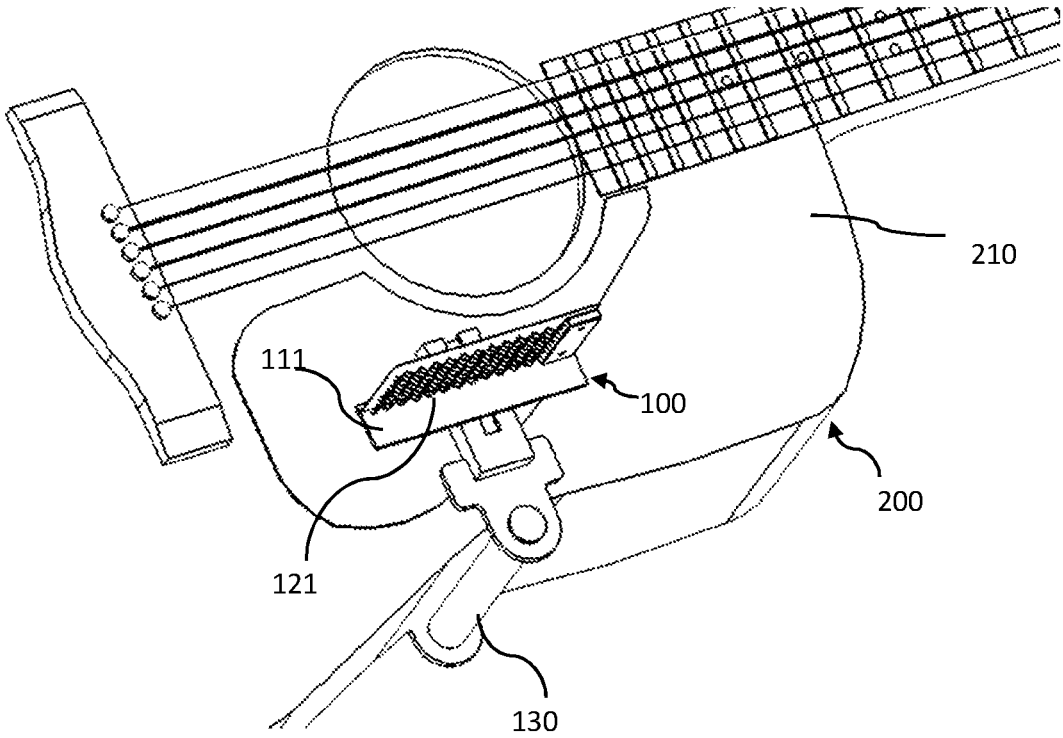

In the exemplary embodiment of FIGS. 4A and 4B system 100 may include one or more snare drum wires 121 connected to percussion surface 120. Percussion surface 120 may be attached to body 110 having a shape of an open frame. The open frame may include one or more support panels 111 to which percussion surface 120 is connected. Such an exemplary embodiment may further include a mechanism or element for stretching the wires. The mechanism may be located or connected to body 110 and may include a screw, a spring, a lever or any other element configured to stretch snare wires. According to some embodiments, system 100 may be connected to stringed instrument 200 such that the snare wires are substantially perpendicular to front side (e.g., panel 210) of instrument 200.

Figure 5A:
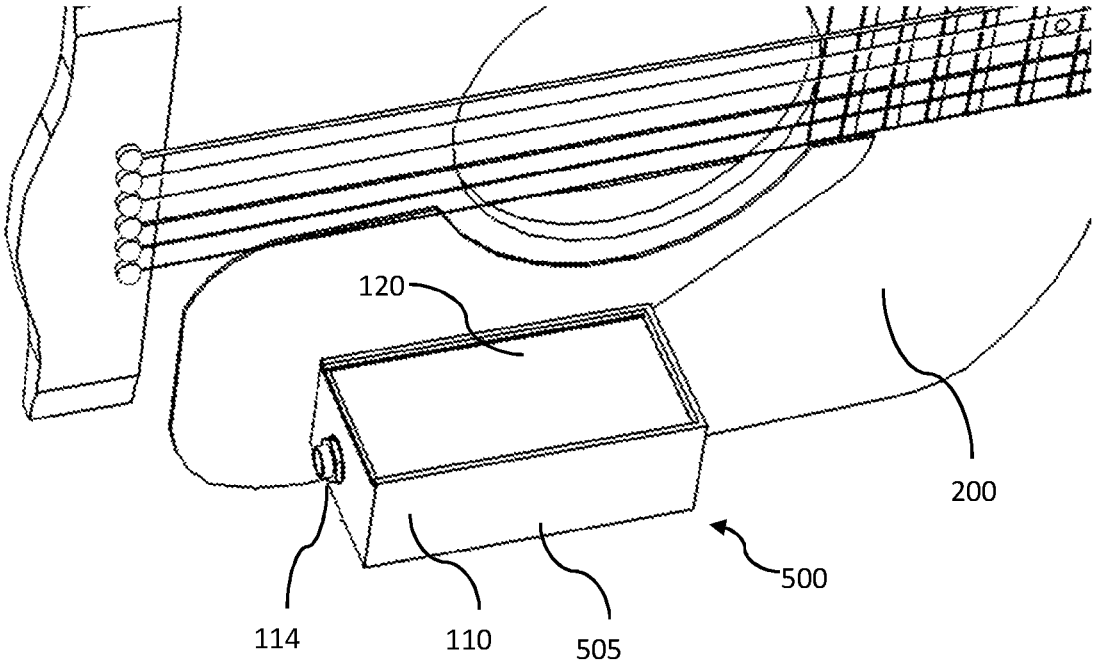
FIGS. 5A and 5B are illustrations of an exemplary percussion device connected to a stringed instrument according to some embodiments of the invention.
Figure 5B:
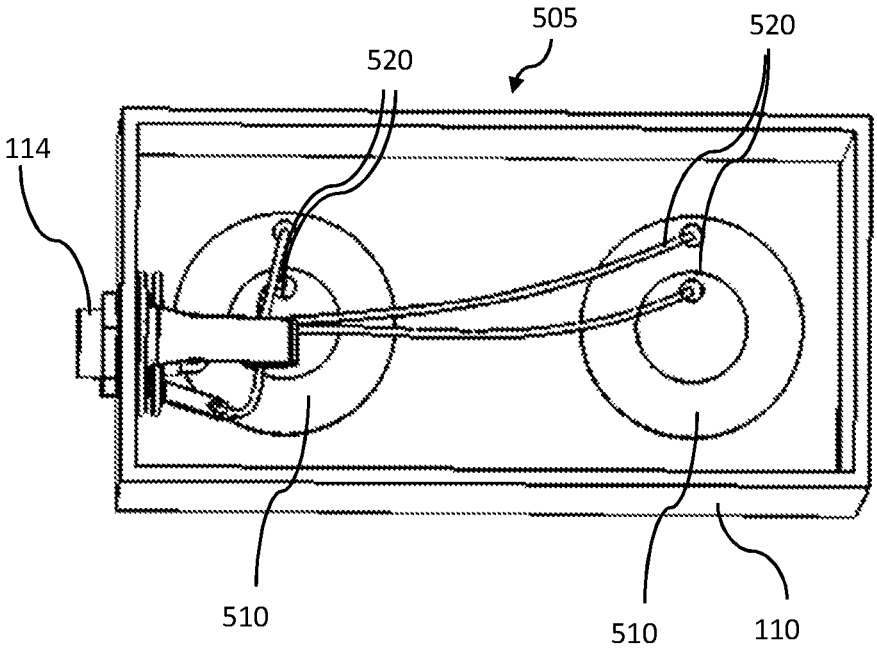

In some embodiments, percussion surface 120 may include an electronic drum trigger. An exemplary percussion system 500 that includes an electronic drum trigger is illustrated in FIGS. 5A and 5B. FIG. 5A is an illustration of a percussion device 505 of system 500 connected to stringed instrument 200 and FIG. 5B is an illustration of a bottom view of percussion device 505 of system 500. Percussion system 500 may include a percussion device 505 and a connecting element 130 (not illustrated) for connecting percussion system 500 to a stringed instrument. Percussion device 505 may include a body 110 and at least one static percussion surface 120 located over body 110.

In some embodiment, the electronic drum trigger included in percussion surface 120 may comprise a surface sensitive to touch connected to a processor or a sound producing module. (e.g., via connector 114). The processor may produce a selection of sounds and effects, from either sampled or modeled sounds saved in a storage unit associated with the processor or the sound producing module. Such sounds may include bass sounds, drumming sounds, instrumental sounds, or the like. Surface 120 of such electronic drum trigger may include a touchscreen, a motion detector, one or more triggers 510 (illustrated in FIG. 5B) or the like. Upon sensing a touch or a hit the surface may send a signal to the processor or sound module to produce a preprogramed sound. The sound may further be amplified by an amplifier in communicating with the processor or drum module. In some embodiments, mounting elements 112 may include clamps for mounting the percussion surface, which includes the electronic drum triggers to body 110.

In the exemplary percussion device 505 of system 500 illustrated in FIGS. 5A and 5B, surface 120 may include two piezoelectric devices 510 connected to internal side of surface 120 (e.g., side 124), optionally via a dumping element. Each of devices 510 may be connected to connector 114 via cables 520. When sensing a hit, one or more devices 510 may send a signal to a sound module or a processor in order to produce a sound, for example, a bass drumming sound.

In some embodiments, percussion system 500 may include one or more piezoelectric devices. The piezoelectric devices may be included in percussion surface 120, for example, device 126 illustrated and discussed with respect to FIGS. 3A and 3B. The piezoelectric device may be included in an electronic drum, such as percussion device 510 illustrated in FIGS. 5A and 5B. Additionally or alternatively, the piezoelectric device may be assembled elsewhere in percussion system 500 and may be configured to act as a microphone, for example, piezoelectric device 150 illustrated in FIG. 3B.

In some embodiments, percussion surface 120 may be a smartphone or a tablet having a touchscreen. The smartphone or tablet may be mounted on body 110 and may further include an application for producing sounds upon sensing a touch or a hit on the touchscreen. A player may select and upload the application and mount the smartphone or tablet to body 110. Mounting elements 112 of body 110 may include in that case mounting system, such as clamps or stickers for mounting the smartphone or tablet.

In some embodiments, a first detachable or replaceable percussion surface 120 may be replaced with a second detachable or replaceable percussion surface 120. Body 110 may include mounting elements (e.g., elements 112) for mounting a detachable percussion surface 120. The first replaceable percussion surface 120 may be configured to produce a first sound and the second replaceable percussion surface 120 may be configured to produce a second sound and the player may choose to replace the replaceable percussion surfaces 120 according to the required sound. The first and second replaceable (detachable) percussion surfaces 120 may be substantially similar, for example, they may both include thin metal plates, when the first and second metal plates may differ in the thickness of the plates. Alternatively, the first and second detachable percussion surfaces 120 may be different from one another, for example, the first percussion surface may include an electronic drum trigger comprising a touchscreen and the second percussion surface may include a bass producing element comprising a piezoelectric device.

In some embodiments, percussion system 100 includes a motion detector (not illustrated) for detecting movement in proximity to the percussion system. The motion detector may include one or more of an optical, ultrasonic, microwave, or acoustic sensors that are configured to detect a movement in proximity to the sensor, for example, at a distance of 1-10 centimeters (cm). The motion detector may be in communication with a sound producing module or a processor stored therein sounds that may be played and amplified using speakers. When detecting a motion at a predetermined distance from the motion detector, for example, a hand swinging at 5 cm from the detector, the detector may send a signal to sound producing module to produce a predetermined sound. Any hand swinging in proximity to the detector may produce a single sound, such that for example, the rhythm of the produced sounds may be similar to the hand swinging frequency.

Figure 5C:
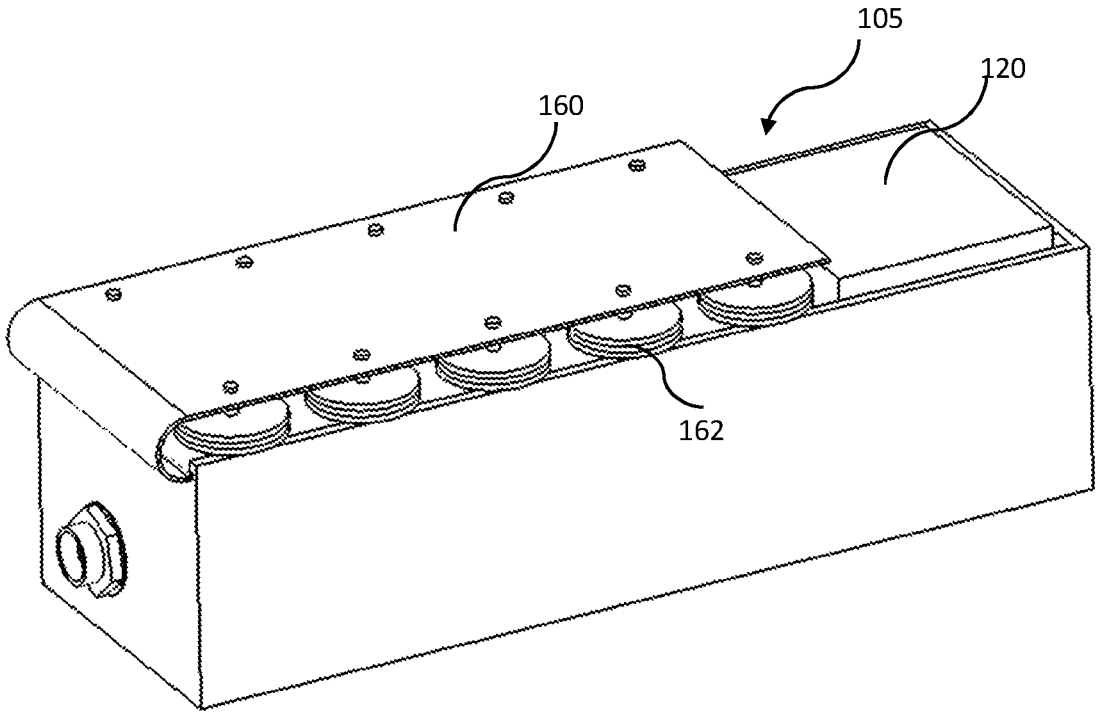
FIG. 5C is an illustration of an exemplary percussion device according to some embodiments of the invention.

In some embodiments, percussion device 105 may further include other percussion or sound producing instruments. For example, percussion device 105 may include a tambourine like device attached or assembled to body 110. FIG. 5C is an illustration of an exemplary percussion device 105 comprising a tambourine like device 160. Tambourine like device 160 may include two or more metal discs 162 configured to hit each other when device 160 is hit by a player. In yet another example, percussion device 105 may include a xylophone assembled or included in percussion surface 120.

In some embodiments, static percussion surface 120 may be configured to electrically trigger a mechanical or an electromechanical tapping device for tapping on, for example, the soundbox of the stringed instrument, or any other surface for producing sound (e.g., a surface not included in the stringed instrument or the percussion device, for example an external drum). Two such exemplary mechanical devices are disclosed herein with respect to FIGS. 6 and 7. Static percussion surface 120 may include a trigger such as, for example, a piezoelectric device, a touch screen, a sensor or any other device that may be configured to trigger an electric signal upon hitting the surface. The electric signal may activate the electromechanical tapping device. The electromechanical tapping device may include: an electric motor or other electromechanical actuator, a transmission unit and a tapping element. The electric motor may be configured to cause the transmission unit to activate the tapping element and cause tapping element to tap on the soundbox of the stringed instrument. Exemplary transmission units 635 and 735 and exemplary tapping elements 650 and 750 are disclosed and discussed below.

In some embodiments, the percussion surface included in a percussion device may be non-static (e.g., dynamic), meaning that it may be configured to move when hit by the player. Such percussion system may further include an actuator, a tapping element and a transmission unit. The actuator may be configured to move along a first axis when a batter side of the percussion surface is hit and the transmission unit may be configured to transfer the actuator's movement along the first axis to a tapping element's movement along a second axis. In some embodiments, the first axis and the second axis may be substantially perpendicular to each other. The percussion device may be connected to the stringed instrument via a connecting element, for example, connecting element 130 that may be configured to connect the percussion device to the stringed instrument such that when the percussion device may be connected to the stringed instrument the batter side of the percussion surface may be substantially perpendicular to the stringed instrument's front panel and may be directed towards strings of the stringed instrument. Exemplary percussion devices each comprising a dynamic percussion surface and a transmission unit are illustrated in FIGS. 6A-6C and 7A-7C.

Figure 6A:
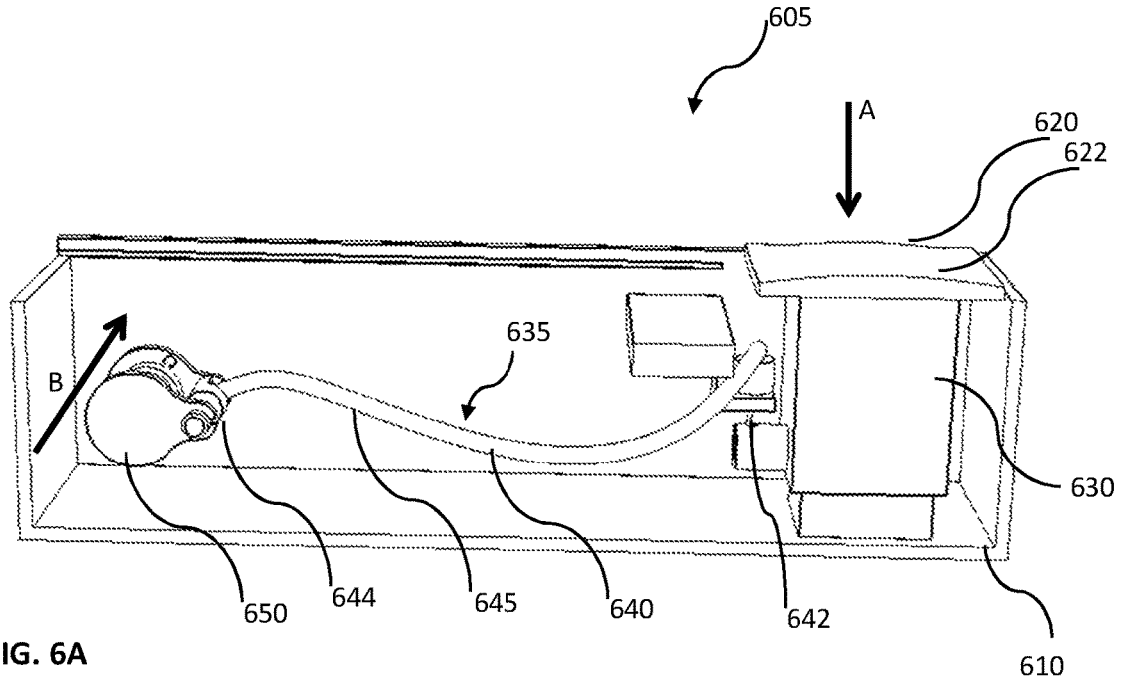
FIGS. 6A-6C are illustrations of an exemplary percussion system according to some embodiments of the invention.
Figure 6B:
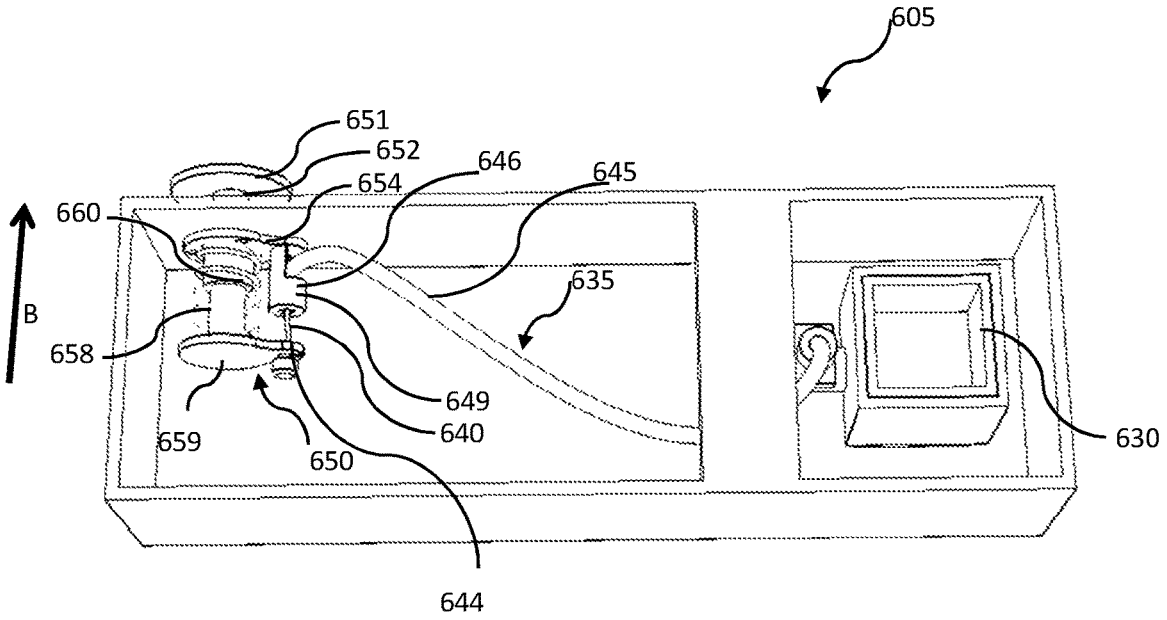
Figure 6C:
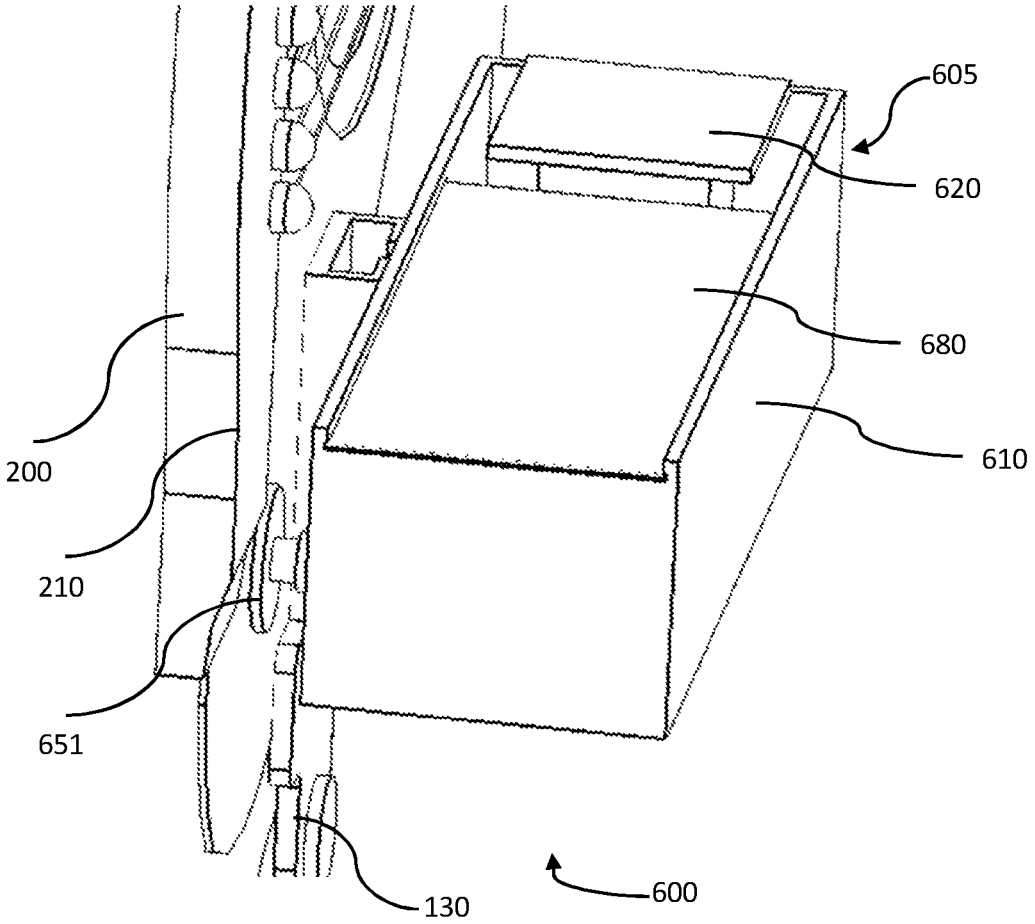

Reference is now made to FIGS. 6A-6C which are illustrations of an exemplary percussion system 600 according to some embodiments of the invention. Embodiments of a percussion system 600 may include a percussion device 605 including a dynamic percussion surface 620, a static percussion surface 680 (illustrated in FIG. 6C), an actuator 630, a transmission unit 635, and a tapping element 650. System 600 may further include a first connecting element 130 for connecting percussion system 600 to stringed instrument 200. In some embodiments, percussion device 605 may further include a body 610. Body 610 may have the same properties as body 110 disclosed above. For example, body 110 may be hollow. According to some embodiments, transmission unit 635 may include: a cable 640 inserted inside a sleeve 645.

Dynamic percussion surface 620 may have a batter side 622 to be hit by a player while plucking the strings (e.g., strings 220) and an internal side (not illustrated). The internal side of percussion surface 620 may be configured to be connected to or to be in contact with actuator 630 when batter side 622 is hit. Actuator 630 may be any system or mechanism that when pushed or hit by dynamic surface 620 may pull cable 640. Actuator 630 may include a spring element configured to return actuator 630 to a starting position when a hand of the player is removed from percussion surface 620. Cable 640 may have a first end 642 connected to actuator 630 and a second end 644. Dynamic percussion surface 620 may be configured to cause actuator 630 to pull first end 642 of cable 640 along a first axis A and to cause second end 644 of the cable 640 to push tapping element 650 along a second axis B. It should be appreciated that axis A and axis B may be perpendicular to each other, parallel to each other or in any other angle between each other.

In some embodiments, when percussion system 600 is connected to stringed instrument 200 using connecting element 130, pulling first end 642 of cable 640 may cause tapping element 650 to tap a soundbox of stringed instrument 200 to produce an acoustic sound. Tapping on the stringed instrument soundbox may form a natural rhythmic bass sound.

In some embodiments, first axis A may be substantially perpendicular to second axis B. For example, the angle between axis A and axis B may be 90°±5°. In some embodiments, at least one end 646 of sleeve 645 may be fixed, for example to body 610, and cable 640 may be configured to slide within sleeve 645, relative to sleeve 645.

In some embodiments, tapping element 650 may include a tapping head 651 located external to body 610 and a shaft 658 connected at one end 652 to tapping head 651. Tapping head 651 may hit front panel 210 of stringed instrument 200 when pushed by a shaft 658, thus tapping or knocking instrument 200 soundbox to produce a sound. Tapping element 650 may further include a second connecting element 654 for connecting tapping element 650 to body 610 of percussion device 605. Second connecting element 654 may have an aperture allowing shaft 658 to pass through body 610. Second connecting element 654 may further be fixed to body 610.

In some embodiments, sleeve 645 may be inserted to a ring 649 statically connected to second connecting element 654 such that cable 640 may move inside ring 649. Cable 640 may be connected to other end 659 of shaft 658 such that when pulled, cable 640 may pulled other end 659 of shaft 658 towards second connecting element 654 causing tapping head 651 to hit stringed instrument 200 front panel 210.

In some embodiments, tapping element 650 may further include a spring 660. In some embodiments, spring 660 may be configured to compress when shaft 658 is pulled by cable 640 and to extend back otherwise, such that when spring 660 is compressed tapping head 651 may tap stringed instrument 200 front panel 210 and when extended, tapping head 651 returns to its original position, by the force of spring 660 pushing the tapping head away from the stringed instrument's front panel 210.

Connecting element 130 may be substantially similar to connecting element 130 disclosed with respect to percussion system 100. Connecting element 130 may connect percussion system 600 to stringed instrument 200 similarly to connecting percussion system 100 to stringed instrument 200, thus all the disclosure above is applicable here.

In some embodiments, percussion system 600 may further include at least one of the embodiments of percussion surface 120 disclosed above (e.g., a drum skin, snare rattlers 140, electronic drum trigger, bass sound forming element 126 or the like). Static percussion surface 680 may be assembled alongside dynamic percussion surface 620, for example, such that static percussion surface 680 covers transmission unit 635, as illustrated in FIG. 6C.

Figure 7A:
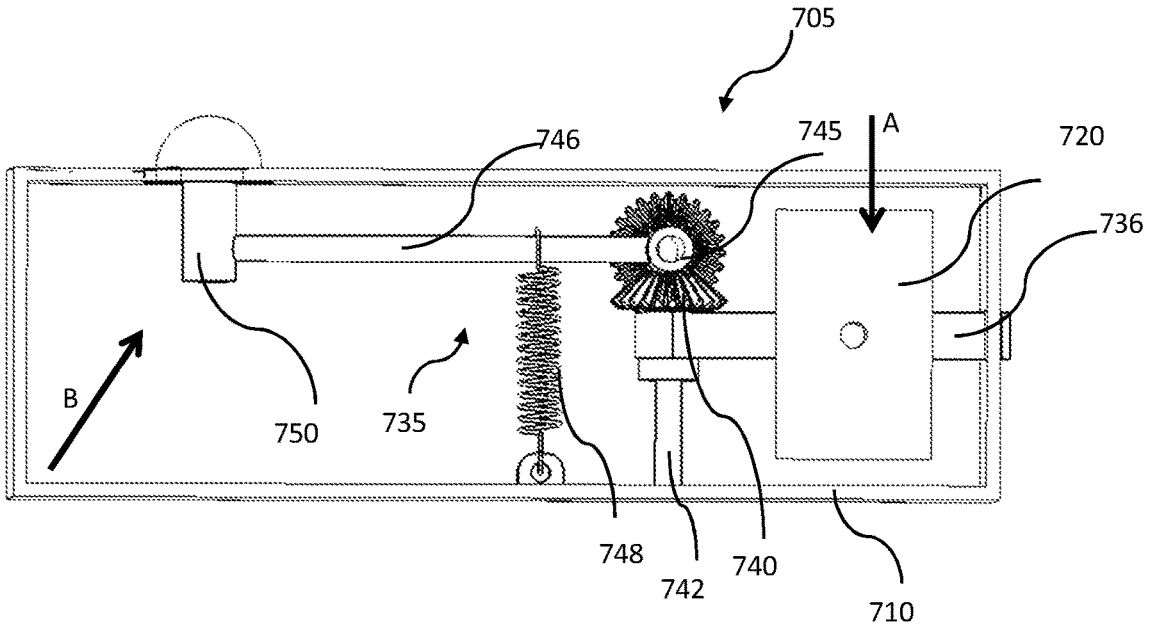
FIGS. 7A-7C are illustrations of an exemplary percussion system according to some embodiments of the invention.
Figure 7B:
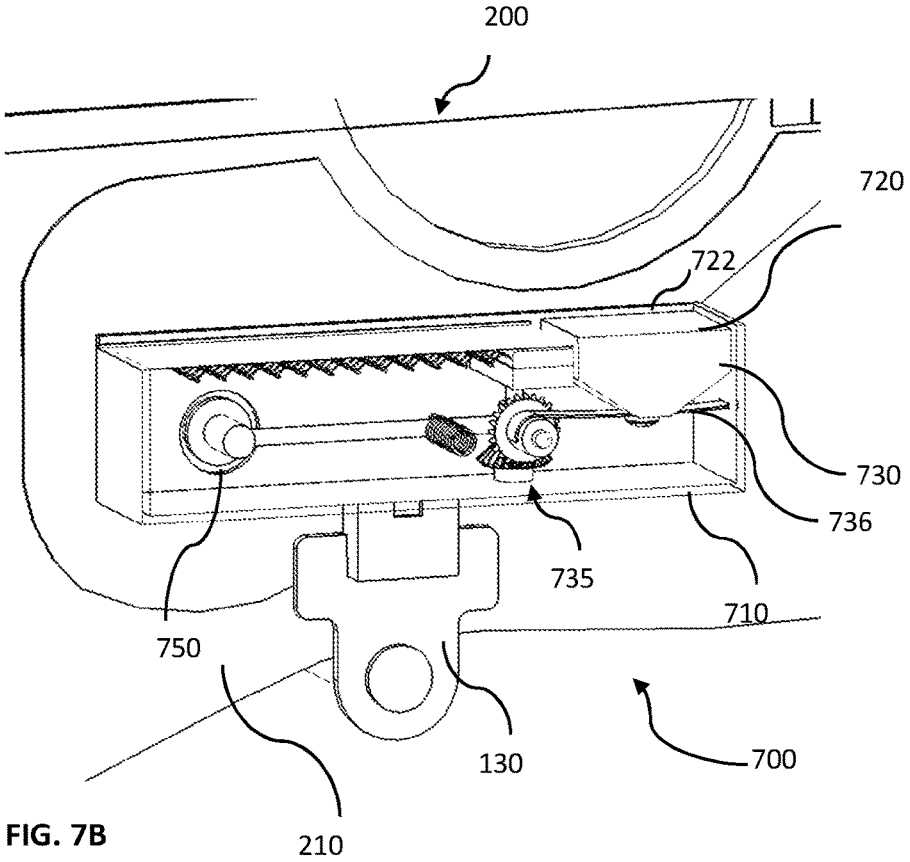
Figure 7C:
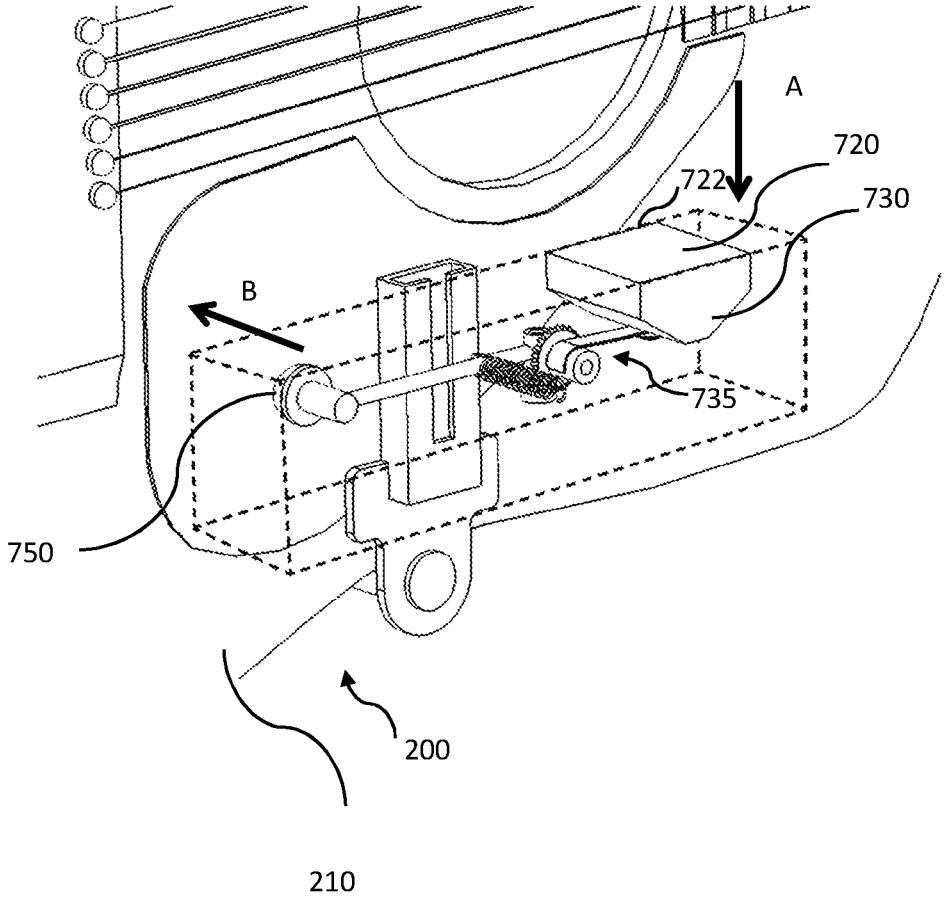

Reference is now made to FIGS. 7A-7C which illustrate an additional embodiment of a percussion system having a dynamic percussion surface according to some embodiments of the invention. A percussion system 700 may include a percussion device 705 including a dynamic percussion surface 720 having a batter side 722 and an internal side (not illustrated), an actuator 730, a tapping element 750 and a transmission unit 735. Percussion device 705 of system 700 may further include a body 710. Body 710 may be substantially similar to some of the embodiments of body 110 discussed above. System 700 may further include a connecting element, such as, connecting element 130.

Actuator 730 may be configured to move along a first axis A (illustrated in FIG. 7C) when batter side 722 of dynamic percussion surface 720 is hit. Actuator 730 may include any mechanism that may transfer the movement at first axis A to transmission-unit 735. Transmission unit 735 may be configured to transfer the actuator's movement along first axis A to tapping element's 750 movement along a second axis B (illustrated in FIG. 7C). In some embodiments, first axis A and second axis B may be substantially perpendicular to each other. Actuator 730 may include a spring element configured to return actuator 730 to a starting position when a hand of the player is removed from dynamic percussion surface 720, or when force applied to batter side 722 is removed.

Transmission-unit 735 may include: belt 736, a first shaft 742 connected to a first conic cogwheel 740 and a second conic cogwheel 745 connected to a second shaft 746. Second shaft 746 may be connected to tapping element 750. Transmission unit 735 may further include a spring 748. Upon hitting percussion surface 720, actuator 730 may be pushed down causing belt 736 to rotate first conic cogwheel 740 around first shaft 742. First conic cogwheel 740 may transfer the rotation movement around first shaft 742 to a movement of second shaft 746 via second conic cogwheel 745. Second shaft 746 may swing to cause the movement of tapping element 750 in the axis B direction towards side panel 210 of stringed instrument 200, illustrated in FIG. 7C.

In some embodiments, transmission-unit 735 may further include a spring 748. In some embodiments, spring 748 may be configured to extract when shaft 746 is pushed by second conic cogwheel 745 and to contract back otherwise, such that when spring 748 is extracted tapping element 750 may tap stringed instrument's front panel 210 and when contracted, tapping element 750 returns to its original position.

Figure 8A:
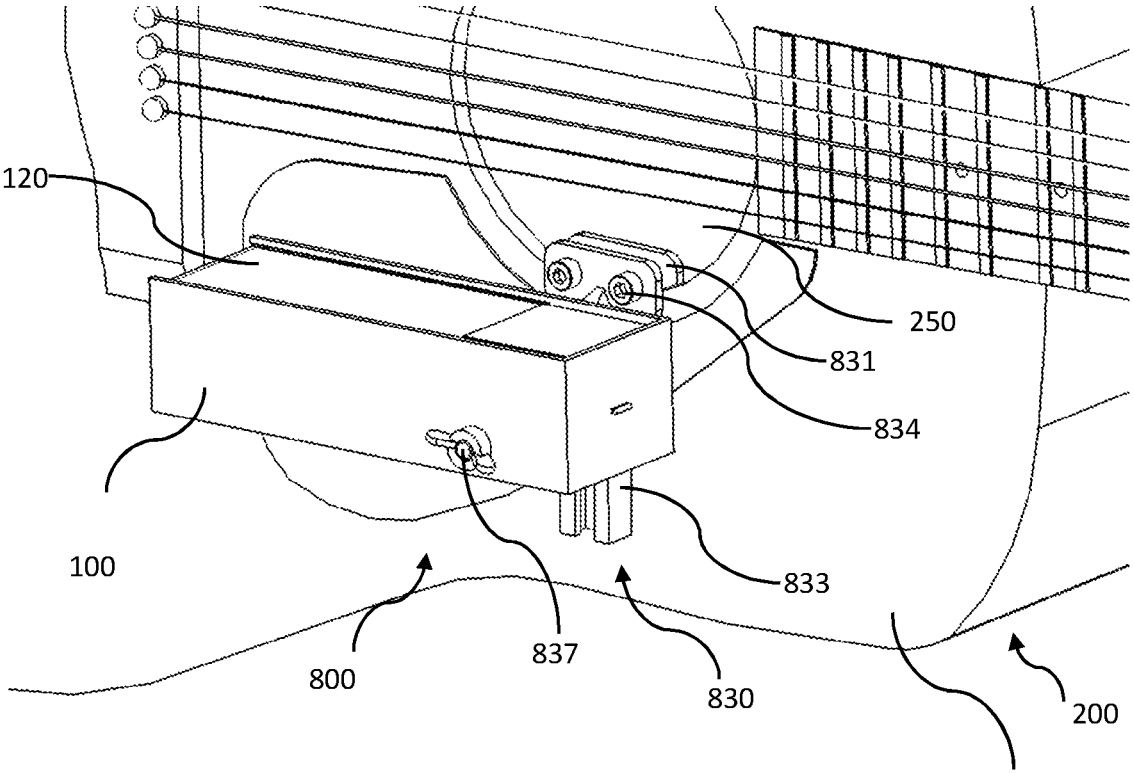
FIG. 8A is an illustration of an example of a percussion system according to some embodiments of the invention.

Reference is now made to FIG. 8A which is an illustration of a percussion system 800 according to some embodiments of the invention. Percussion system 800 may include a percussion device 105, for example, as illustrated in FIG. 1A (or any other percussion device disclosed and discussed above, e.g., devices 505, 605 and 705 in FIGS. 5A, 6A and 7A respectively) and a connecting element 830 for connecting percussion device 105 to stringed instrument 200. Connecting element 830 may connect percussion device 105 to string instrument 200 such that when percussion system 800 is connected to stringed instrument 200 percussion surface 120 may be substantially perpendicular to stringed instrument's front side 210 and may be directed towards strings 220 of stringed instrument 200.

Figure 8B:
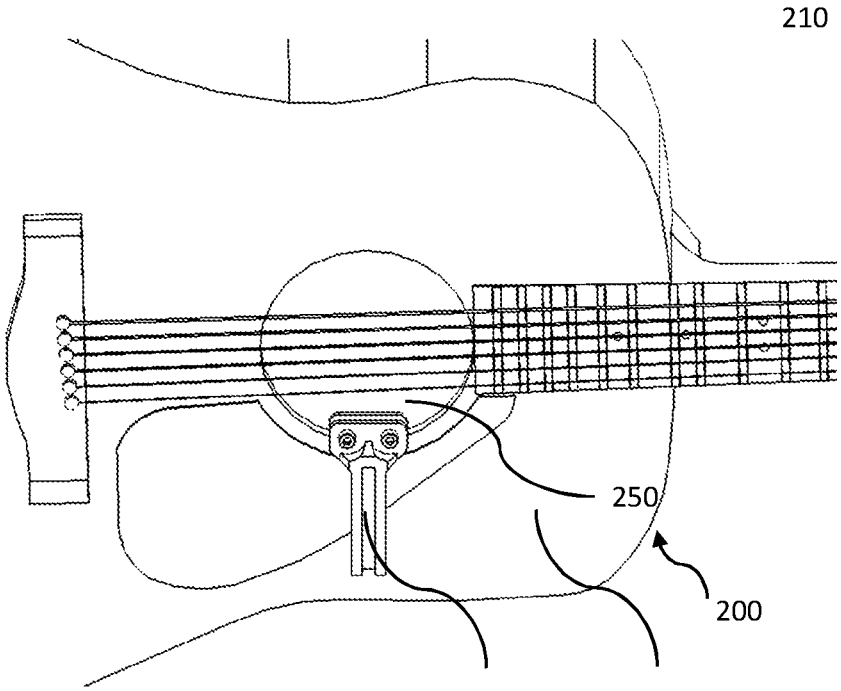
FIGS. 8B and 8C are illustrations of a connecting element according to some embodiments of the invention.
Figure 8C:
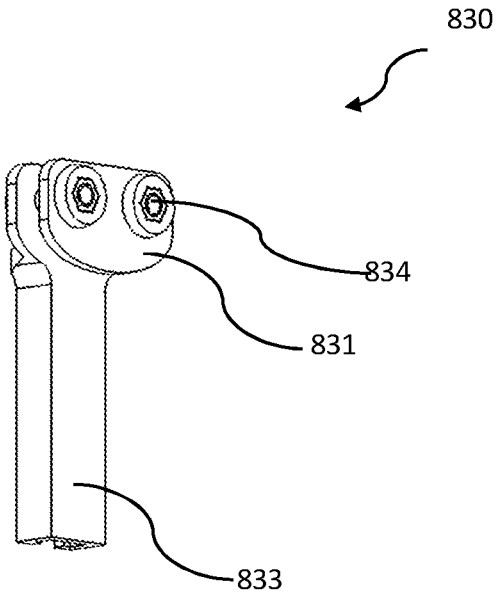

Connecting element 830 may be configured to be suspended from the lower edge of a sound hole 250, as illustrated more elaborately in FIG. 8B. FIGS. 8B and 8C are illustrations of a connecting element according to some embodiments of the invention. Connecting element 830 may include a plate 831, a holder 833 and a spacer 834. Spacer 834 may be bolts, screws or any other elements that may be configured to form a desired space between plate 831 and holder 833. The desired space may be at least in the size of the thickness of front side panel 210 of stringed instrument 200. In some embodiments, spacer 834 may be configured to allow the adjustments of the spacing between plate 831 and holder 833, for example, to fit to a specific stringed instrument 200. In some embodiments, at least two of plate 831, holder 833 and spacer 834 may be included in a single element. In some embodiments, spacer 834 may form a constant space, configured to fit a specific stringed instrument (e.g., an acoustic guitar) and plate 831, holder 833 and spacer 834 may all be formed as a single unit.

Holder 833 may be configured to hold or be attached to percussion device 105, for example, using screw 837 (illustrated in FIG. 8A). In some embodiments, holder 833 may be attached (and detached) from percussion device 105 using other means, for example, magnets, clamps, etc.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A percussion system, comprising:

a percussion device comprising:

a body; and at least one static percussion surface located over the body, the percussion surface having a batter side, wherein the at least one static percussion surface is statically connected to the body in a way that does not allow the static percussion surface to substantially move with respect to the body; and a connecting element for connecting the percussion device to a stringed instrument such that when the percussion system is connected to the stringed instrument the percussion surface is substantially perpendicular to the stringed instrument's front side and is directed towards strings of the stringed instrument.

2. A percussion system according to claim 1, further comprising:

a dynamic percussion surface having a batter side;

an actuator;

a tapping element; and a transmission unit;

wherein the dynamic percussion surface is capable of moving with respect to one of: the body and the connecting element.

3. A percussion system according to claim 1, wherein the body is a hollow body.

4. A percussion system according to claim 1, wherein the connecting element connects the percussion system to the stringed instrument such that a player can hit the static percussion surface while plucking the strings of the stringed instrument with the player's plucking hand.

5. A percussion system according to claim 4, wherein the connecting element is configured to allow at least one of: adjusting a location of the percussion system and adjusting an orientation of the percussion system.

6. A percussion system according to claim 1, wherein the connecting element is located on a side of the body perpendicular to the percussion surface, and is at least one of: a removable sticker, a suction cup, hook and loop fastener, bolt, magnet, and at least one screw.

7. A percussion system according to claim 1, wherein the connecting element is a clamp configured to removably connect the percussion device to the stringed instrument such that the percussion surface is substantially perpendicular to the stringed instrument's front side and is directed towards strings of the stringed instrument.

8. A percussion system according to claim 1, wherein the at least one percussion surface comprises at least one of: (i) an elastic material stretched over the body and (ii) a rigid material plate placed over the body and connected to the body from at least one side of the plate.

9. A percussion system according to claim 1, wherein the percussion surface is replaceable.

10. A percussion system according to claim 1, further comprising a rattler.

11. A percussion system according to claim 1, wherein the static percussion surface comprises at least one bass-sound forming element.

12. A percussion system according to claim 1, further comprising a motion detector for detecting movement in proximity to the percussion system, wherein the motion detector is in communication with a sound producing unit.

13. A percussion system according to claim 1, wherein the percussion surface comprises at least one trigger of an electronic drum.

14. A percussion system, comprising:

a percussion surface having a batter side;

an actuator;

a tapping element;

a transmission unit; and a connecting element, wherein the actuator is configured to move along a first axis when the batter side of the percussion surface is hit, wherein the transmission unit is configured to transfer the actuator's movement along the first axis to a tapping element's movement in a direction towards a side panel of a stringed instrument along a second axis, when the percussion system is connected to the stringed instrument;

wherein the first axis is different from the second axis; and wherein the connecting element is configured to connect the percussion system to the stringed instrument such that when the percussion system is connected to the stringed instrument the batter side of the percussion surface is substantially perpendicular to the stringed instrument's front panel and is directed towards strings of the stringed instrument.

15. A percussion system according to claim 14 wherein when the percussion system is connected to the stringed instrument, moving the actuator causes the tapping element to tap a soundbox of the stringed instrument.

16. A percussion system according to claim 14, further comprising a body.

17. A percussion system according to claim 14, wherein the tapping element comprises:

a tapping head; and a shaft connected at one end to the tapping head.

18. A percussion system according to claim 14, wherein the tapping element further comprises:

a spring element, wherein the spring element is configured to return the actuator to a starting position.

19. A percussion system according to claim 14, wherein the connecting element connects the percussion system to the stringed instrument such that a player can hit the batter side of the percussion surface while plucking the strings of the stringed instrument with the player's plucking hand.

20. A percussion system according to claim 14, wherein the connecting element is configured to allow at least one of: adjusting a location of the percussion system and adjusting an orientation of the percussion system.

* * * * *